US007785404B2

(12) United States Patent
Leng et al.

(10) Patent No.: US 7,785,404 B2
(45) Date of Patent: Aug. 31, 2010

(54) IONIC AIR PURIFIER WITH HIGH AIR FLOW

(75) Inventors: Shengwen Leng, Shenzen (CN); Guangsheng Liu, Shenzen (CN)

(73) Assignee: Sylmark Holdings Limited, Dublin (IE)

( * ) Notice: Subject to any disclaimer, the term of this patent is extended or adjusted under 35 U.S.C. 154(b) by 0 days.

(21) Appl. No.: 11/538,009

(22) Filed: Oct. 2, 2006

(65) Prior Publication Data

US 2008/0078295 A1 Apr. 3, 2008

(51) Int. Cl.
*B03C 3/68* (2006.01)

(52) U.S. Cl. ..... 96/21; 95/6; 95/80; 96/22; 96/79; 96/82; 96/83; 96/96

(58) Field of Classification Search ..... 96/21, 96/22, 80–82, 96, 60, 77–79, 83, 95, 98, 96/99; 95/6, 80, 81, 78, 79; 323/903
See application file for complete search history.

(56) References Cited

U.S. PATENT DOCUMENTS 4,445,911 A * 5/1984 Lind ..... 95/6
4,936,876 A * 6/1990 Reyes ..... 95/6
5,737,197 A * 4/1998 Krichtafovitch et al. ..... 363/17
6,312,507 B1 * 11/2001 Taylor et al. ..... 96/19
6,646,856 B2 * 11/2003 Lee et al. ..... 361/232
6,908,501 B2 * 6/2005 Reeves et al. ..... 96/29
6,946,103 B1 * 9/2005 Spiegel ..... 422/186
7,122,070 B1 * 10/2006 Krichtafovitch ..... 95/2
7,300,493 B2 * 11/2007 Kim et al. ..... 95/2
2006/0075893 A1 * 4/2006 Kim et al. ..... 95/8
2007/0039462 A1 * 2/2007 Helt et al. ..... 95/6

FOREIGN PATENT DOCUMENTS

GB 2096845 A * 10/1982 ..... 96/21

* cited by examiner

*Primary Examiner*—Richard L Chiesa

(57) ABSTRACT

An air purifier includes a housing, a high voltage power supply, a first electrode assembly in which a wire-like first electrode is either the only first electrode or, alternatively, is spaced sufficiently far from any other such first electrodes so as to avoid undesirable effects upon each other, and a second electrode assembly in which there are a plurality of blade-like second electrodes. The air purifier can be of the type in which air flows through the housing as a result of electro-kinetic effects. To increase air flow velocity, the voltage between first and second electrodes is relatively high, such as 23-50 kV, and the first and second electrodes are accordingly spaced apart a relatively great distance, such as at least 30 mm.

6 Claims, 4 Drawing Sheets

IONIC AIR PURIFIER WITH HIGH AIR FLOW

BACKGROUND OF THE INVENTION

1. Field of the Invention

The present invention relates generally to electrostatic or ionic air purifiers and, more specifically, to an ionic air purifier having a high air flow volume and clean air delivery rate (CADR).

2. Description of the Related Art

An ionic air purifier typically includes a louvered or grilled housing in which an ionizer unit electrostatically attracts and removes particulate matter from the air. The ionizer unit includes two spaced-apart arrays of electrodes coupled to the respective positive and negative high voltage output ports of a power supply. The electrodes of one array, which are sometimes referred to in the art as a corona electrodes, are typically thin and wire-like, and electrodes of the other array, which are sometimes referred to as collector electrodes, are typically blade-shaped. The voltage between the electrodes is typically on the order of 10-20 kilovolts.

Ionic air purifiers typically utilize electro-kinetic principles to produce air flow without the use of fans or other mechanically moving parts. The electric field that is generated between the first and second electrode arrays produces an electro-kinetic airflow moving from the first array toward the second array. Ambient air, including dust particles and other undesired particulate matter, enters the housing through the grill or louver openings on the upstream side of the housing, is charged by the corona electrode array, and particulate matter entrained in the air is electrostatically attracted to the surface of the collector electrode array, where it remains, thus removing particulate matter from the flow of air exiting the housing through the grill or louver openings on the downstream side of the housing. The collector electrode array can be cleaned of trapped particulate matter by removing the assembly from the housing and wiping the blades with a cloth.

The high voltage electric field present between electrode arrays can cause a corona effect that generates ozone ($O_3$) and nitrogen oxides ($NO_x$). Ozone inhibits the growth of bacteria, molds and viruses and helps eliminate odors in the output air, but as high concentrations of ozone are harmful to human health, it is desirable to control the release of ozone.

Low air flow velocity and concomitant low air flow volume, i.e., the amount of air that moves through the purifier in a given amount of time, are problems with conventional ionic air purifiers of the type described above. While it is known that increasing the power drawn by the electrode arrays will increase the electro-kinetic airflow, it can also increase generation of undesirable amounts of ozone and nitrogen oxides.

It would therefore be desirable to provide an ionic air purifier that maximizes air flow volume yet controls generation of ozone and other corona effect products. The present invention addresses these problems and deficiencies and others in the manner described below.

SUMMARY OF THE INVENTION

An air purifier includes a housing, a high voltage power supply, a first electrode assembly in which a wire-like first electrode (or corona electrode) is either the only first electrode or, alternatively, is spaced sufficiently far from any other such first electrodes so as to avoid undesirable effects upon each other, and a second electrode assembly in which there are a plurality of blade-like second electrodes. The air purifier can be of the type in which air flows through the housing as a result of electro-kinetic effects.

It has been discovered in accordance with the present invention that, as the first electrode's electrical field is a vector, and only the component in the desired direction of air flow through the housing contributes to the desired electro-kinetic effect, the presence of nearby electric fields from other such first electrodes can undesirably increase air flow in directions other than the desired direction of air flow through the housing. The resulting turbulent flow can inhibit maximum air flow in the desired direction. In embodiments of the invention in which there are more than one first electrode, any first electrode is preferably spaced no closer than about 40 millimeters (mm) (and more preferably 75 mm) from any other first electrode, though the spacing can depend upon the voltage (electrical potential) between the first and second electrodes.

Preferably, the power supply provides an electrical potential between the first electrode and the second electrodes that is substantially higher than that which conventional air purifiers of this general type provide, such as 23-50 kilovolts (kV). The relatively high voltage (in comparison with conventional air purifiers) results in relatively high air flow velocity and concomitant high air flow volume, thereby providing a relatively high clean air delivery rate (CADR).

Other features of the invention address issues relating to high voltage. For example, is it preferred that no portion of a second electrode be closer than about 30 mm from any portion of the first electrode, though the spacing can depend upon the voltage. In the exemplary embodiment of the invention, the voltage is 23-50 kilovolts, and the spacing between the closest respective points on the first electrode and any second electrode is 30-50 mm.

DETAILED DESCRIPTION

Figure 1:
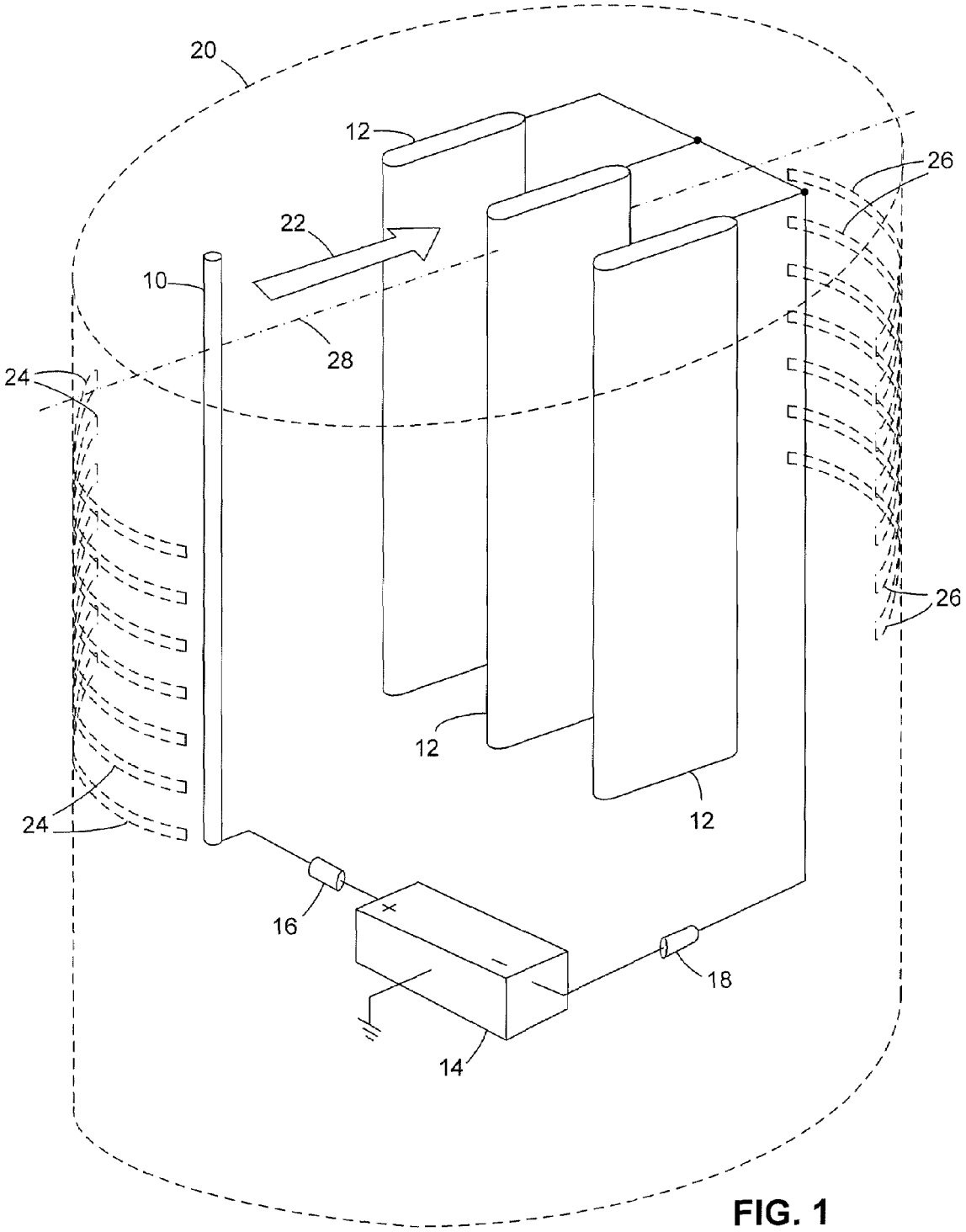
FIG. 1 is a perspective view of elements of an air purifier in accordance with an embodiment of the present invention.

As illustrated in FIG. 1, in an exemplary embodiment of the invention, an ionic air purifier includes a wire-like first electrode 10 (sometimes referred to in the art as a corona electrode) and a plurality of blade-like second electrodes 12 (sometimes referred to in the art as collection electrodes). Although three second electrodes 12 are shown in FIG. 1 for purposes of illustration, there can be more or fewer such second electrodes in other embodiments. A positive terminal of a high voltage power supply 14 is coupled to first electrode 10 via a current-limiting resistor 16, a negative terminal of power supply 14 is coupled to each of second electrodes 12 via another current-limiting resistor 18, and a ground terminal is coupled to earth ground or equivalent.

First electrode 10 preferably comprises a thin wire, about 0.2 millimeters (mm) in diameter, but wires or other thin, elongated structures between about 0.1 and 0.3 mm in diameter or width may be suitable. For example, a razor-thin strip or ribbon may be suitable. Second electrodes 12 are blade-like or paddle-like in that they have broad, substantially similar opposing surfaces. Although the opposing surfaces are flat or planar and parallel to each other in the illustrated embodiment of the invention, in other embodiments they can be curved, cambered, contoured, etc., can have surface features, or any other suitable blade-like shape. Nevertheless, smooth, featureless surfaces are believed to minimize undesirable corona. To further minimize corona, one or both edges of second electrodes has a blunt, rounded shape, preferably with a radius of curvature greater than about 1 mm. Electrodes 10 and 12 can be made of any suitable conductive material, though a material that resists corrosion and is easily cleanable, such as stainless steel, is preferred.

The above-described elements can be housed in a suitable housing 20 and retained in suitable mechanical assemblies (not shown for purposes of clarity), for example, as described in U.S. Pat. No. 6,946,103, entitled "AIR PURIFIER WITH ELECTRODE ASSEMBLY INSERTION LOCK," the specification of which is incorporated herein in its entirety by this reference. With reference to a desired direction of air flow through housing 20, indicated by the arrow 22, an upstream side of housing 20 has grill-like or louver-like intake apertures 24, and a downstream side of housing 20 has similar exhaust apertures 26. When the indicated electrical potential is applied between first electrode 10 and second electrodes 12, the resulting electro-kinetic effect causes air to enter housing 20 through intake apertures 24, flow through housing 20 past electrodes 10 and 12, and exit the housing 20 through exhaust apertures 26. Particulate matter entrained in the air is electrostatically attracted to the surfaces of electrodes 12 and collects upon the surfaces.

Note that in the exemplary embodiment illustrated in FIG. 1, there is only a single first electrode 10. It has been discovered in accordance with the present invention that the presence of nearby electric fields from other such first (i.e., corona) electrodes, as in some conventional purifiers, can undesirably increase air flow in directions other than that indicated by arrow 22, thereby interfering with air flow in the desired direction.

The amount of kinetic energy imparted to the air through the electro-kinetic effect increases with an increase in power consumed by the circuit defined by first and second electrodes 10 and 12. Thus, to maximize air flow velocity, it may at first glance seem optimal to maximize power. However, high electrode current can result in the corona effect generating undesirable amounts of ozone and nitrogen oxides. Rather than maximizing current, as power is the mathematical product of voltage and current, the present invention maximizes voltage (within what are believed to be safe and otherwise desirable limits for a consumer product) and controls electrode current.

Although power supply 14 is described in further detail below, it can be noted here that in the exemplary embodiment it provides an electrical potential between first electrode 10 and each of second electrodes 12 of about 23-50 kilovolts (kV). Still more preferably, it provides a potential of about 30 kV. With a potential of about 23-50 kV, the electrode current is generally less than about 500 microamperes (μA). To avoid applying excessive voltage to any one electrode (with respect to ground), the potential can be divided equally or at least approximately equally between first electrode 10 and each second electrode 12. Thus, for example, in an embodiment in which power supply 14 provides a potential of 30 kV between first electrode 10 and each of second electrodes 12, power supply 14 can provide a potential of +15 kV with respect to ground to first electrode 10 and a potential of −15 kV with respect to ground to each of second electrodes 12. Nevertheless, in other embodiments the reference ground can be omitted.

The optimal distance or spacing between first electrode 10 and the closest point on any of second electrodes 12 depends upon the electrical potential between them. A higher potential militates a greater distance or spacing to minimize corona. A portion of the axis 28 shown in FIG. 1 extends between respective closest points on first electrode 10 and a second electrode 12. The spacing between respective closest points along axis 28, i.e., between the trailing edge of first electrode 10 and the leading edge of the middle second electrode 12 ("leading" and "trailing" referring to the direction of air flow), is preferably at least 30 mm and, more preferably, 30-50 mm. An optimal spacing is believed to be about 35-45 mm. The spacing between the respective closest points on adjacent second electrodes is preferably 25-40 mm.

Although in this embodiment of the invention, axis 28 is parallel to the direction of air flow (arrow 22), in other embodiments the axis extending between respective closest electrode points may be oriented in any other suitable manner. Similarly, although in this embodiment second electrodes 12 are parallel to the direction of air flow, parallel to each other, and parallel to first electrode 10, in other embodiments they can be oriented in any other suitable manner. Nevertheless, orienting electrodes 12 in the manner shown in FIG. 1 and with first electrode 10 and one of second electrodes 12 along the same axis 28 as the direction of air flow is believed to maximize air flow.

Figure 2:
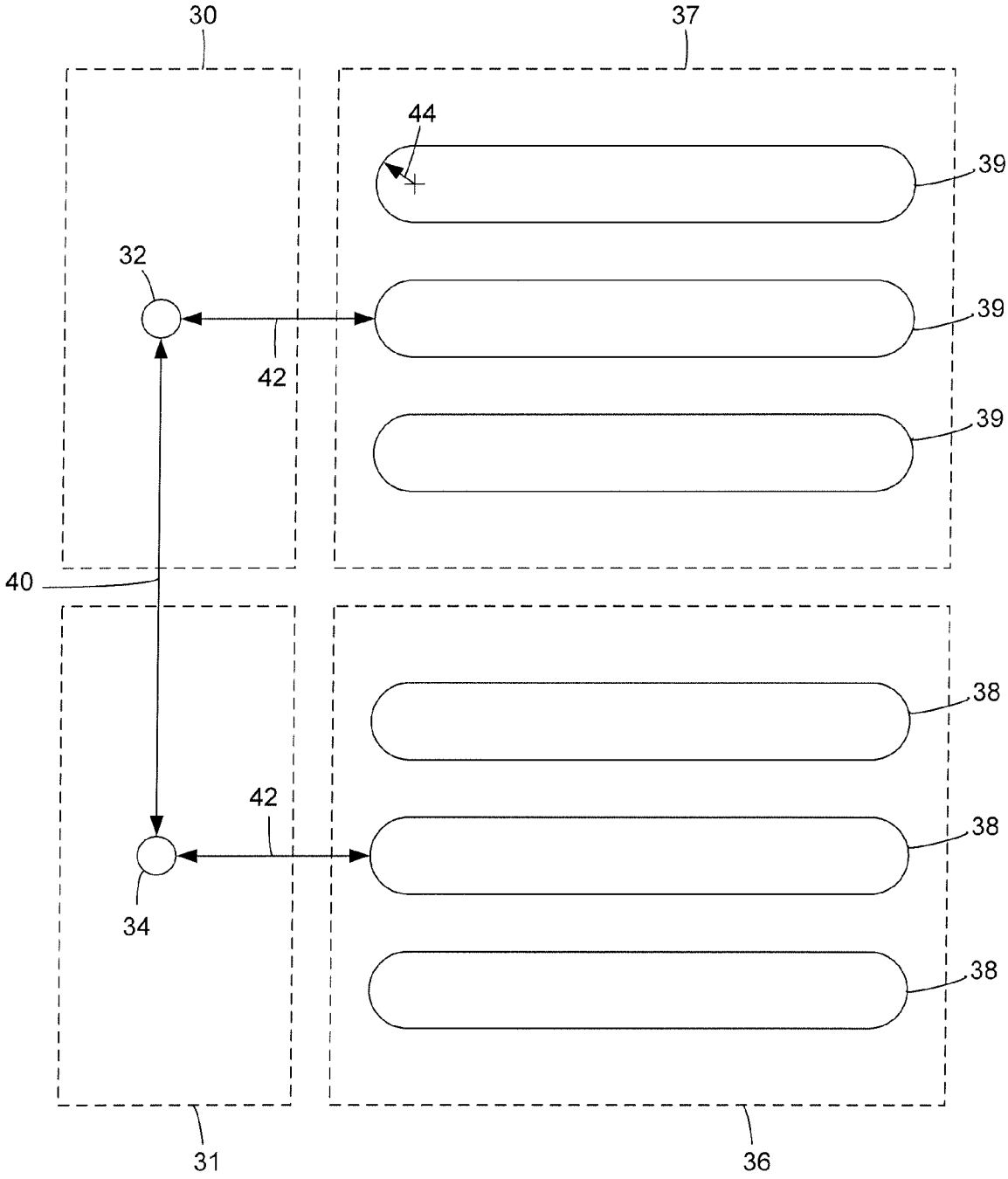
FIG. 2 is a top view of elements of an air purifier in accordance with another embodiment of the present invention.

As illustrated in FIG. 2, in another embodiment of the invention two first electrode assemblies 30 and 31, respectively include first electrodes 32 and 34, and two second electrode assemblies 36 and 37, respectively include two groups of second electrodes 38 and 39. Although in this embodiment each group of second electrodes 38 and 39 corresponds to one of first electrode assemblies 30 and 32, in other embodiments the number of first electrode assemblies may be different from the number of second electrode assemblies. For example, in a similar embodiment (not shown), electrodes 38 and 39 can be included in the same assembly.

Electrodes 32, 34 and 36 are as described above with regard to the embodiment illustrated in FIG. 1. Importantly, there is a spacing or distance 40 between first electrodes 32 and 34 of at least about 75 mm to avoid undesirable electric field interaction that is believed to inhibit air flow. Thus, they are included in separate assemblies 30 and 31. As described above with regard to the embodiment illustrated in FIG. 1, the spacing or distance 42 between the closest points on first electrodes 32 and 34 and any second electrode 38 or 39 is preferably at least about 30 mm and, still more preferably, between about 30 and 50 mm. Optimally, distance 42 is between about 38 and 40 mm. Nevertheless, as noted above, the optimal distance and electrode voltage are inter-dependent. In all other respects, this embodiment of the invention is as described above with regard to the embodiment illustrated in FIG. 1. Note the above-described radius of curvature 44 of at least about 1 mm of the leading edges of second electrodes 38 and 39.

Figure 3:
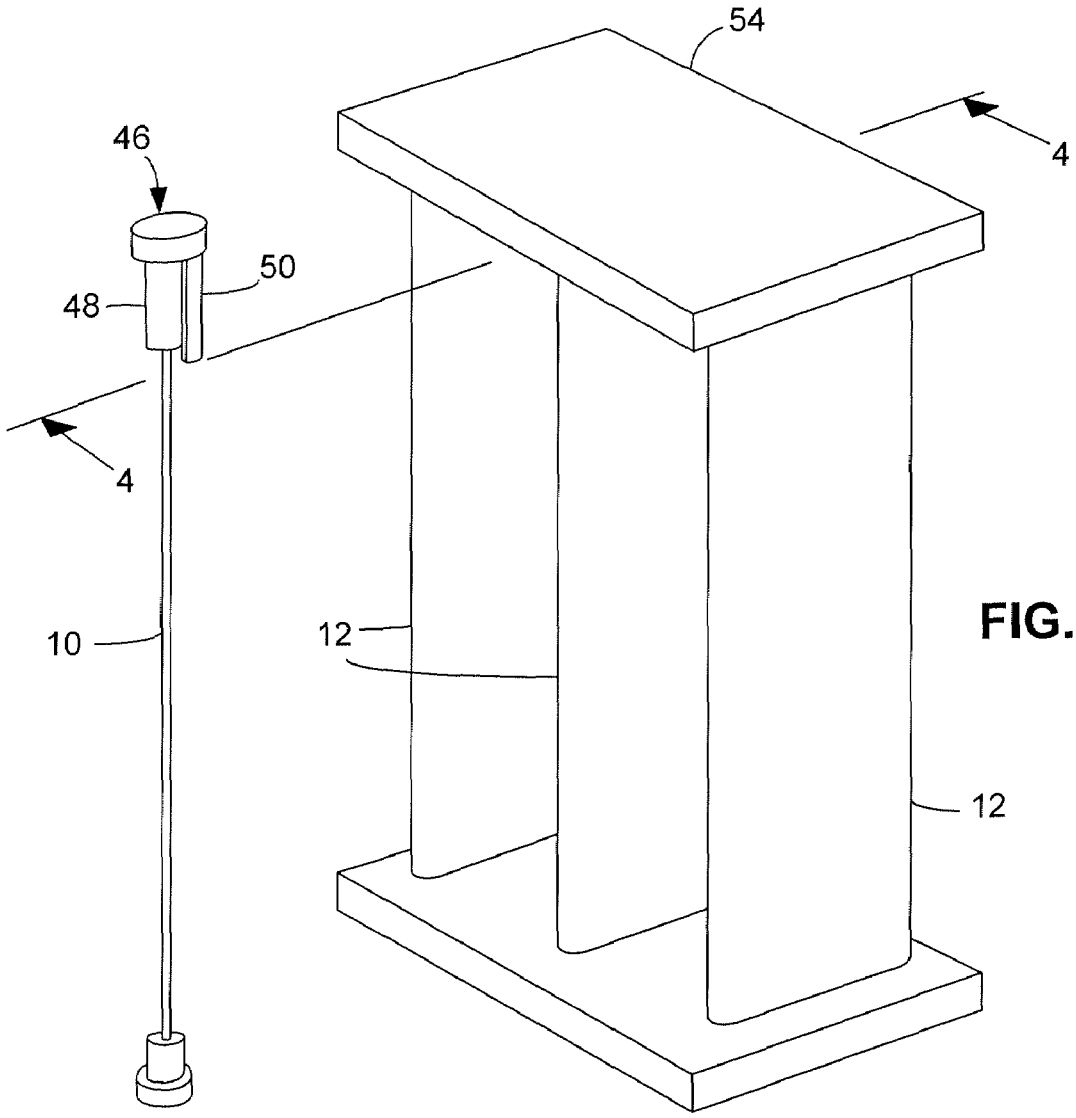
FIG. 3 is a perspective view of the electrode assemblies of FIG. 1, illustrating a dielectric guard in the first electrode assembly.
Figure 4:
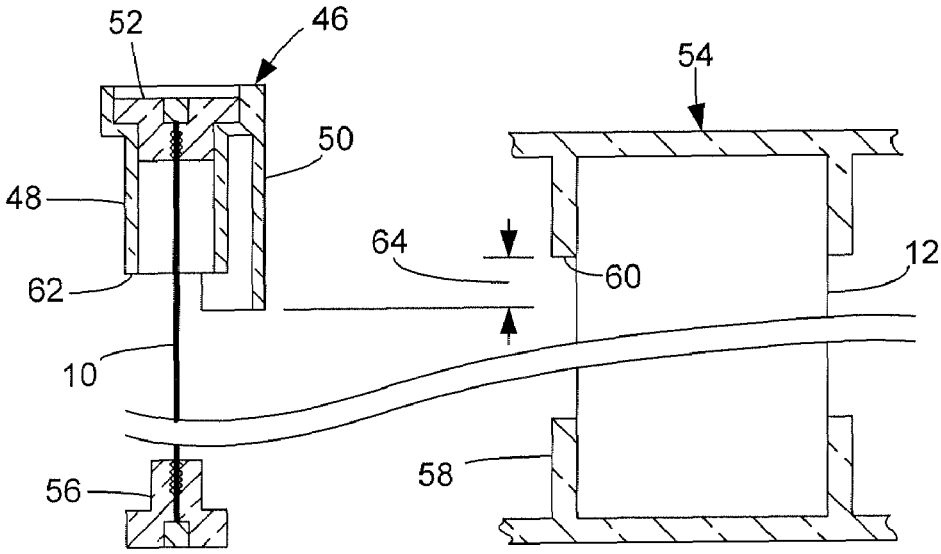
FIG. 4 is a cross-sectional view taken on line 4-4 of FIG. 3.

The manner in which a first electrode (e.g., electrode 10 in FIG. 1) is retained in a first electrode assembly and shielded with a guard 46 that enhances distribution of the magnetic field is illustrated in FIGS. 3-4. Guard 46 is made of a dielectric material suitable for shielding against corona discharge, such as plastic or ceramic. Guard 46 comprises a hollow tubular portion 48 and a semi-tubular extension 50. One end of first electrode 10 is retained in a retainer 52 inside guard 46 made of a suitable dielectric material such as plastic or ceramic. Similarly, the corresponding end of each second electrode 12 is retained in a suitable dielectric retainer 54 that is part of the second electrode assembly. Although retainer 54 is shown in generalized or conceptualized form in FIGS. 3-4 for purposes of clarity, the electrode assembly can have a structure along the lines of that described in the above-referenced U.S. Pat. No. 6,946,103 or as otherwise known in the art. The other end of first electrode 10 is retained in a retainer 56 that can be similar to retainer 52, and the corresponding other end of each second electrode 10 is retained in a retainer 58 that can be similar to retainer 54. Features of retainers 54 and 58 and the electrode assembly in which they are included that allow the electrode assembly to be removed from housing 12 (FIG. 1) for cleaning and retained or locked in housing 12 during operation are described in the above-referenced U.S. Pat. No. 6,946,103.

Note that the end 60 of retainer 54 extends to a location between the ends of first electrode 10, approximately even or level with the end of 62 of tubular portion 62. It has been found that the electrical field can be unevenly distributed because first electrode 10 and second electrode 12 have unequal lengths, which can result in electrical discharge noise emanating primarily from the areas where the ends of electrode 10 are retained. To adjust the distribution of the electric field and thereby maintain quiet operation, semi-tubular extension 50 extends a distance 64 beyond this location. Preferably, distance 64 is at least 5 mm. Although this double-wall shielding arrangement with tubular portion 62 and extension 50 is suitable, in other embodiments guard 46 can be structured differently. For example, tubular portion 62 can be longer, extending approximately distance 64 beyond the end 60 of retainer 54.

Figure 5:
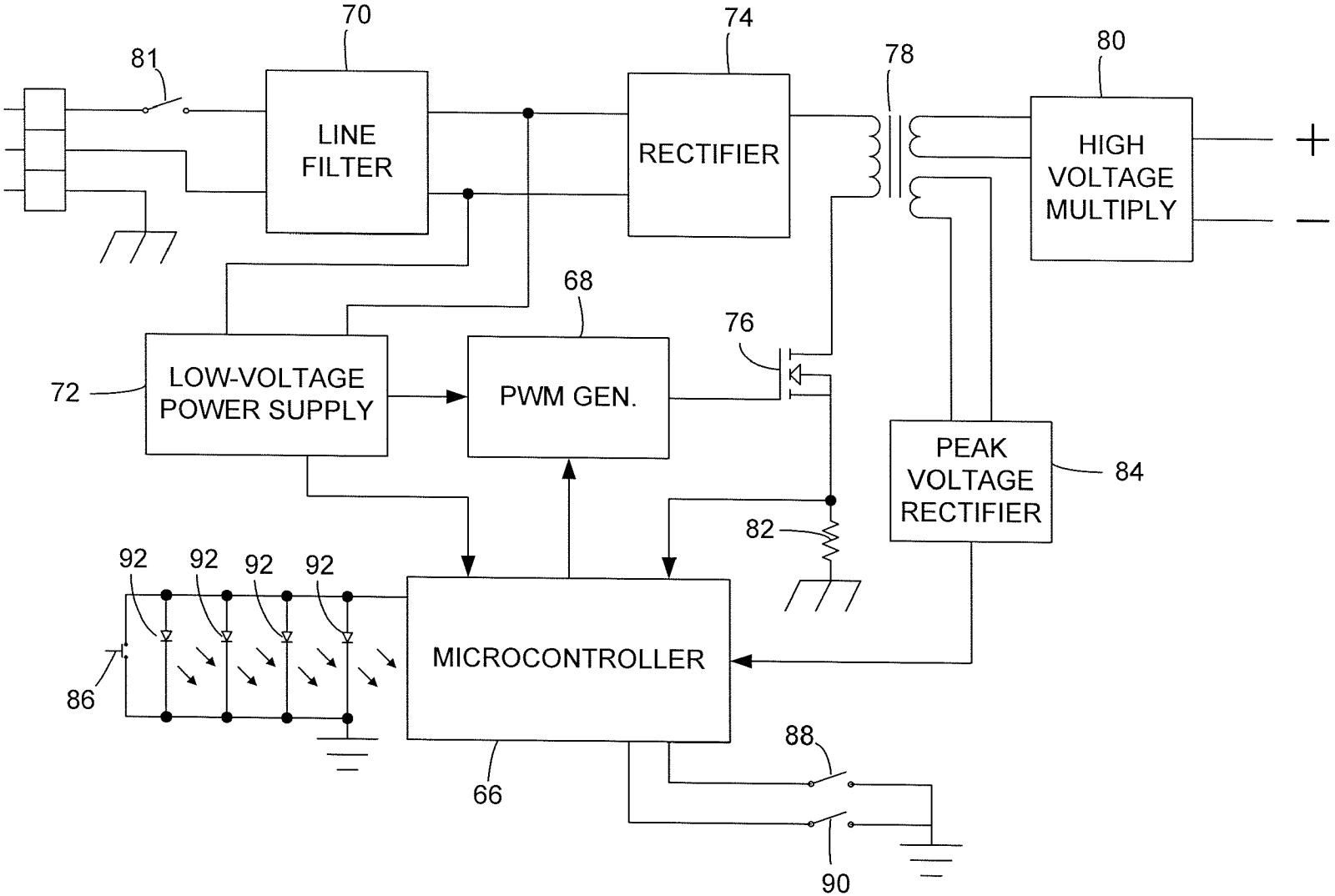
FIG. 5 is a block diagram of a power supply circuit of the air purifier of FIG. 1.

As illustrated in FIG. 5, power supply 14 (FIG. 1) operates in a closed-loop or feedback manner to regulate electrode current. As described below in further detail, the circuit responds to changes in electrode current that can occur as a result of changes in humidity and particulate matter in the air by controlling electrode voltage.

The power supply circuit primarily comprises a microcontroller 66, a pulse-width modulation (PWM) signal generator 68, a line filter 70, a low voltage power supply 72, a rectifier 74, a MOSFET 76, a transformer 78, and a high voltage multiplier 80. As controlled by a main power switch 81, line filter 70 receives and filters household utility power (e.g., 120 VAC). Low voltage power supply 72 receives the filtered utility power and provides the digital voltage (e.g., 5 VDC) required to power microcontroller 66. Rectifier 74 converts the AC power to DC, and transformer 78 steps up the voltage. High voltage multiplier 80 similarly multiplies the stepped-up voltage to the (e.g., +15 and −15 kV) electrode voltages. The circuit through the primary side of transformer 78 is coupled to ground through the drain terminal of MOSFET 76 and a resistor 82. This circuit also provides a feedback signal, representative of electrode current, to microcontroller 66. A peak voltage rectifier 84 tapping into the output of transformer 78 allows microcontroller 66 to monitor peak voltage. A reset switch 86 and two control switches 88 and 90 allow a user to control the operation of the power supply (e.g., "on", "off", etc.) and thus of the air purifier as a unit. Microcontroller 66 also controls a number of status indicator LED's 92.

Microcontroller 66 digitizes the feedback signal and, in response to the corresponding digital value, adjusts the digital signal it provides to PWM signal generator 68. The pulse train output by PWM signal generator 68 controls MOSFET 76. Changes in the duty cycle and frequency of the pulse train cause MOSFET 76 to adjust the output voltage (indicated by "+" and "−" at the output of high voltage multiplier 80) accordingly. If the circuit senses an increase in electrode current above a predetermined normal operational value (e.g., 300 μA), the circuit responds by lowering the output voltage by an amount needed to maintain essentially constant power. In addition, if microcontroller 66 senses an electrode current that is beyond normal operational range by a predetermined amount, it responds by shutting off power to avoid potentially harmful conditions.

It will be apparent to those skilled in the art that various modifications and variations can be made to this invention without departing from the spirit or scope of the invention. Thus, it is intended that the present invention cover the modifications and variations of this invention provided that they come within the scope of any claims and their equivalents. With regard to the claims, no claim is intended to invoke the sixth paragraph of 35 U.S.C. Section 112 unless it includes the term "means for" followed by a participle.

What is claimed is:

1. An air purifier, comprising:

a housing having apertures for admitting and expelling air flowing through the housing;

a first electrode assembly in the housing, the first electrode assembly comprising a first wire electrode and no more than one first wire electrode;

a second electrode assembly in the housing, the second electrode assembly comprising a plurality of second blade electrodes, each second blade electrode disposed substantially parallel to the first wire electrode, wherein each second blade electrode has blunt leading and trailing edges, and at least one of the leading and trailing edge of each blade second electrode has a radius of curvature greater than about 1 mm, and wherein no portion of the plurality of second blade electrodes are disposed closer than about 30 mm from any portion of the first wire electrode; and a high voltage power supply for providing an electrical potential between the first electrode and each of the second electrodes of 23-50 kilovolts (kV), the power supply having a feedback circuit for responding to changes in electrode current by controlling electrode voltage.

2. The air purifier claimed in claim 1, wherein the feedback circuit includes a pulse-width modulation (PWM) circuit for providing pulse-width modulated signal to the electrodes, and the feedback circuit responds to changes in electrode current by modulating the signal.

3. The air purifier claimed in claim 1, wherein the first wire electrode has a diameter greater than about one-tenth of one millimeter (0.1 mm) and less than about three-tenths of one millimeter (0.3 mm).

4. The air purifier claimed in claim 1, wherein the plurality of second blade electrodes are disposed between 30 mm and 50 mm from the first wire electrode.

5. The air purifier claimed in claim 1, further comprising:

a guard made of a dielectric material interposed between the first electrode and the second electrode assembly;

wherein a first end of the first wire electrode is seated in a first dielectric retainer, and a corresponding first end of one of the plurality of second blade electrodes is seated in a second dielectric retainer, the first end of the second blade electrode being seated in the second dielectric retainer between the first end of the first wire electrode and a second end of the first wire electrode, and at least a portion of the guard extends between the first dielectric retainer and the second dielectric retainer.

6. An air purifier, comprising:

a housing having apertures for admitting and expelling air flowing through the housing;

a first electrode assembly in the housing, the first electrode assembly comprising a first wire electrode and no more than one first wire electrode;

a second electrode assembly in the housing, the second electrode assembly comprising a plurality of second blade electrodes, each second blade electrode disposed substantially parallel to the first wire electrode, wherein each second blade electrode has blunt leading and trailing edges, and at least one of the leading and trailing edge of each blade second electrode has a radius of curvature greater than about 1 mm, and wherein no portion of the plurality of second blade electrodes are disposed closer than about 30 mm from any portion of the first wire electrode;

a high voltage power supply for providing an electrical potential between the first electrode and each of the second electrodes of 23-50 kilovolts (kV), the power supply having a feedback circuit for responding to changes in electrode current by controlling electrode voltage;

a guard made of a dielectric material interposed between the first electrode and the second electrode assembly;

wherein a first end of the first wire electrode is seated in a first dielectric retainer, and a corresponding first end of one of the plurality of second blade electrodes is seated in a second dielectric retainer, the first end of the second blade electrode being seated in the second dielectric retainer between the first end of the first wire electrode and a second end of the first wire electrode, and at least a portion of the guard extends between the first dielectric retainer and the second dielectric retainer.

* * * * *